United States Patent [19]

Semel

[11] Patent Number: 4,834,800

[45] Date of Patent: May 30, 1989

[54] IRON-BASED POWDER MIXTURES

[75] Inventor: Frederick J. Semel, Cinnaminson, N.J.

[73] Assignee: Hoeganaes Corporation, Riverton, N.J.

[21] Appl. No.: 919,047

[22] Filed: Oct. 15, 1986

[51] Int. Cl.[4] ..... C07C 143/02; C09C 1/62

[52] U.S. Cl. ..... 106/403; 106/460; 428/570; 252/513; 524/440

[58] Field of Search ..... 428/570; 252/511, 513; 106/308 M, 460, 403; 75/255; 427/131; 524/439, 440, 441

[56] References Cited

U.S. PATENT DOCUMENTS

| | | | |
|---|---|---|---|
| 3,307,924 | 3/1967 | Michael | 29/182.5 |
| 3,470,019 | 9/1969 | Steele | 117/227 |
| 3,516,933 | 6/1970 | Andrews et al. | 252/12 |
| 3,846,126 | 11/1974 | Foley et al. | 75/211 |
| 3,988,524 | 10/1976 | Dreyer et al. | 428/403 |
| 4,062,678 | 12/1977 | Dreyer et al. | 75/228 |
| 4,075,384 | 2/1978 | Suzuki et al. | 427/127 |
| 4,106,932 | 8/1978 | Blachford | 75/252 |
| 4,116,906 | 9/1978 | Ishino et al. | 106/308 M |
| 4,181,525 | 1/1980 | Novinski | 75/255 |
| 4,268,599 | 5/1981 | Russell | 106/308 M |
| 4,483,905 | 11/1984 | Engström | 428/570 |
| 4,491,559 | 1/1985 | Grab et al. | 419/36 |
| 4,502,982 | 3/1985 | Horie et al. | 524/440 |
| 4,504,441 | 3/1985 | Kuyper | 419/35 |
| 4,545,926 | 10/1985 | Fouts et al. | 252/511 |
| 4,634,627 | 1/1987 | Fujiki et al. | 428/900 |
| 4,676,831 | 6/1987 | Engstrom | 75/252 |

FOREIGN PATENT DOCUMENTS

| | | | |
|---|---|---|---|
| 435474 | 10/1967 | France . | |
| 1582157 | 9/1969 | France | 428/570 |
| WO85/01230 | 3/1985 | PCT Int'l Appl. . | |
| 2149714 | 6/1985 | United Kingdom . | |

OTHER PUBLICATIONS

"Pressing the Hard to Press Powders", C. T. Waldo, IBM Corporation.

"Binders for Briquetting and Agglomeration", Henry C. Messman, Proceedings of the 15th Biennial Conference, pp. 173–178.

"Agglomeration: Growing Larger in Applications and Technology", Jon E. Browning Chemical Engineering, Dec. 4, 1967, pp. 147–170.

"Influence on Precision of PM Parts of Various Binder Additions to Powder", J. Tengzelius and U. Engstrom, Powder Metallury, 1985, vol. 28, No. 1, pp. 43–48.

*Primary Examiner*—Theodore Morris

*Attorney, Agent, or Firm*—Woodcock Washburn Kurtz Mackiewicz & Norris

[57] ABSTRACT

An improved powder composition of an iron-based powder and an alloying powder is provided. Segregation and dusting of the alloying powder is eliminated or substantially reduced when the powder composition contains a polymeric binding agent which is an adherent film-former and which is insoluble in water.

35 Claims, No Drawings

IRON-BASED POWDER MIXTURES

BACKGROUND OF THE INVENTION

The present invention relates to homogenous iron-based powder mixtures of the kind containing iron or steel powders and at least one alloying powder. More particularly, the invention relates to such mixtures which contain an improved binder component and which are therefore resistant to segregation or dusting of the alloying powder.

The use of powder metallurgical techniques in the production of myriad metal parts is well established. In such manufacturing, iron or steel powders are often mixed with at least one other alloying element, also in particulate form, followed by compaction and sintering. The presence of the alloying element permits the attainment of strength and other mechanical properties in the sintered part at levels which could not be reached with unalloyed iron or steel powders alone.

The alloying ingredients which are normally used in iron-based powder mixtures, however, typically differ from the basic iron or steel powders in particle size, shape, and density. For example, the average particle size of the iron-based powders normally used in the manufacture of sintered metal parts is typically about 70–80 microns. In contrast, the average particle size of most alloying ingredients used in conjunction with the iron-based powders is less than about 20 microns, most often less than 15 microns, and in some cases under 5 microns. Alloying powders are purposely used in such a finely-divided state to promote rapid homogenization of the alloy ingredients by solidstate diffusion during the sintering operation. Nevertheless, this extremely fine size, together with the overall differences between the iron-based and alloying powders in particle size, shape, and density, make these powder mixtures susceptible to the undesirable separatory phenomena of segregation and dusting.

In general, powder compositions are prepared by dry-blending the iron-based powder and the alloying powder. Initially, a reasonably uniform blend is attained, but upon subsequent handling of the mixture, the difference in morphology between the two powder components immediately causes the two different powders to begin to separate. The dynamics of handling the powder mixture during storage and transfer cause the smaller alloying powder particles to migrate through the interstices of the iron-based powder matrix. The normal forces of gravity, particularly where the alloying powder is denser than the iron powder, cause the alloying powder to migrate downwardly toward the bottom of the mixture's container, resulting in a loss of homogeneity of the mixture (segregation). On the other hand, air currents which can develop within the powder matrix as a result of handling can cause the smaller alloying powders, particularly if they are less dense than the iron powders, to migrate upwardly. If these buoyant forces are high enough, some of the alloying particles can escape the mixture entirely, the additional phenomenon of dusting, resulting in a decrease in the concentration of the alloy element.

U.S. Pat. No. 4,483,905 to Engstrom teaches that the risk of segregation and dusting can be reduced or eliminated if a binding agent of "a sticky or fat character" is introduced during the original admixing of the iron-based and alloying powders in an amount of about 0.005–1.0% by weight. Specifically disclosed binders are polyethylene glycol, polyropylene glycol, glycerine, and polyvinyl alcohol. Although the Engstrom binders are effective in preventing segregation and dusting, they are, by definition, limited to substances which do not "affect the characteristic physical powder properties of the mixture such as apparent density, flow, compressibility and green strength" (Column 2, lines 47–51). Accordingly, the practical application of iron-based powder mixtures would be greatly enhanced by the provision of binding agents which not only effectively reduce segregation and dusting but also improve the green properties of the powder as well as the properties of the final sintered articles.

SUMMARY OF THE INVENTION

The present invention provides an improved powder composition of the kind comprising (a) an iron-based powder selected from the group consisting of iron powders and steel powders, (b) a minor amount of at least one alloying powder, and (c) a binding agent for said iron-based and alloying powders, said composition having been formed by mechanically mixing said iron-based powder and said alloying powder with said binding agent, wherein the improvement is characterized in that the binding agent is a resin substantially insoluble in water selected from the group consisting of (1) Homopolymer of vinyl acetate or copolymers of vinyl acetate in which at least 50% of the monomeric units are vinyl acetate;
(2) Cellulosic ester or ether resins;
(3) Methacrylate polymers or copolymers:
(4) Alkyd resins;
(5) Polyurethane resins; and
(6) Polyester resins.

The binding agents of the invention improve the powder composition by imparting enhanced green properties to the powder as well as to the final articles sintered from the powder. More particularly, the binding agents improve one or more of such "green" properties as apparent density, flow, green strength, and compressibility or one or more of such sintered properties as sintered dimensional change and transverse rupture strength. Although in some instances a decrease in one or more of these properties might also occur, the improvement in the other property or properties is generally greater and offsetting.

DETAILED DESCRIPTION OF THE INVENTION

The present invention provides an improvement over the specific binding agents of Engstrom and resides, at least in part, in the use of binding agents which, unlike those of Engstrom, are substantially insoluble in water and can enhance the physical properties of the powder or sintered articles made from the powder.

According to the present invention, the improved binders are polymeric resins which preferably are film-forming compounds and are insoluble or substantially insoluble in water. By way of background, binders such as those of U.S. Pat. No. 4,483,905 are generally added to the admixture of iron-based powder and alloying powder in the form of a solution of the binder. Water solutions, however, have been found to be economically undesirable for the incorporation of binders or other agents into the powder mixtures, because, for example, the time necessary to dry the powder subsequent to the binder incorporation is significantly greater than is the case if an organic solvent such as acetone or methanol, is used. Additionally, it has been found that many water soluble binders in general show a greater tendency to absorb water under wet or humid powder-storage conditions than do water-insoluble polymers. This is a drawback, therefore, even if water is not originally used to incorporate the binder, since the binder's own affinity for water can maintain some residual dampness in the powder itself, decreasing the powder's flowability and, in most circumstances, eventually leading to rust.

Accordingly, the improvements of the present invention are provided by the use as a binding agent of polymeric resins that are insoluble or substantially insoluble in water. Preferably, the resins are adherent film-formers, meaning that application of a thin covering of the resin in liquid form (that is, in natural liquid state or as a solution in an organic solvent) to a substrate will result in a polymeric coating or film on the substrate upon natural curing of the resin or evaporation of the solvent. It is also preferred that the binding agent be a substance which pyrolyses relatively cleanly during sintering to avoid depositing a residual phase of non-metallurgic carbon or other chemical debries on the surfaces of the particles. The existence of such phases can lead to weak interparticle boundaries, resulting in decreased strength in the sintered materials.

With regard to the above, preferred binding agents are as follows:

(1) Homopolymers and copolymers of vinyl acetate. The copolymers are the polymerization product of vinyl acetate with one or more other ethylenically-unsaturated monomers, wherein at least 70% of the monomeric units of the copolymer are vinyl acetate. Preferred among these resins is polyvinyl acetate itself.

(2) Cellulosic ester and ether resins. Examples are ethylcellulose, nitrocellulose, cellulose acetate, and cellulose acetate butyrate. Preferred among the cellulosic resins is cellulose acetate butyrate.

(3) Methacrylate polymers and copolymers. The resins of this group are homopolymers of the lower alkyl esters of methacrylic acid or copolymers consisting of polymerized monomeric units of two or more of those esters. Examples are homopolymeric methyl methacrylate, ethyl methacrylate, or butyl methacrylate, and copolymeric methyl/n-butyl methacrylate or n-butyl-/iso-butyl methacrylate. Preferred is a homopolymer of n-butyl methacrylate.

(4) Alkyd resins. The alkyd resins contemplated for use herein are those which are the thermosetting reaction product of a polyhydric alcohol and a polybasic acid (or its anhydride) in the presence of a modifier, such as an oil, preferably, a drying oil, or a polymerizable liquid monomer. Examples of the alcohol are ethylene glycol or glycerol, and examples of the acids are phthalic acid, terephthalic acid, or a $C_2$–$C_6$ dicarboxylic acid. Typical oils are linseed oil, soybean oil, tung oil, or tall oil. Modifiers other than drying oils are, for example, styrene, vinyl toluene, or any of the methacrylate esters described above. Typically, the alkyd resin is available as a solution of the aforesaid reaction product in the liquid modifier, which is subsequently cured or polymerized at the time of use. Preferred among the alkyd resins are reaction products of $C_2$–$C_6$ dicarboxylic acid or phthalic acid and ethylene glycol, modified with vinyl toluene, (5) Polyurethane resins. The polyurethane resins contemplated for use herein are the thermoplastic condensation products of a polyisocyanate and a hydroxyl-containing or amino-containing material. Three sub-groups of the polyurethanes are separately identified as follows:

(a) Pre-polymers containing free isocyanate groups which are curable upon exposure to ambient moisture;

(b) Two-part systems of (i) a pre-polymer having free isocyanate groups, which forms a solid film upon combination with (ii) a hydroxyl or amine-containing catalyst or cross-linking agent such a a monomeric polyol or a polyamine; and (c) Two-part systems of (i) a pre-polymer having free isocyanate groups, which forms a solid film upon combination with (ii) a resin having active hydrogen atoms. Preferred among the polyurethane resins are the moisture-curable polyurethane prepolymers.

(6) Polyester resins. The polyester resins contemplated for use herein are prepared by cross-linking the condensation product of an unsaturated dicarboxylic acid and a dihydroxy alcohol with another ethylenically-unsaturated monomer. Examples of the acids are unsaturated $C_4$–$C_6$ acids, such as maleic acid or fumaric acid, and examples of the alcohols are $C_2$–$C_4$ alcohols, such as ethylene glycol or propylene glycol. Generally, the condensation product is preformed, and is dissolved in the monomer, or in a solvent also containing the monomer, with which it is to be cross-linked. Examples of suitable cross-linking monomers are diallyl phthalates, styrene, vinyl toluene, or methacrylate esters as described earlier. Preferred among the polyesters are maleic acid/glycol adducts diluted in styrene.

Mixtures of the binding agents can also be used.

The binding agents of the invention are useful to prevent the segregation or dusting of the alloying powders or special-purpose additives commonly used with iron or steel powders. (For purposes of the present invention, the term "alloying powder" refers to any particulate element or compound added to the iron or steel powder, whether or not that element or compound ultimately "alloys" with the iron or steel.) Examples of the alloying powders are metallurgical carbon, in the form of graphite; elemental nickel, copper, molybdenum, sulfur, or tin; binary alloys of copper with tin or phosphorus; ferro-alloys of manganese, chromium, boron, phosphorus, or silicon; low-melting ternary and quaternary eutectics of carbon and two or three of iron, vanadium, manganese, chromium, molybdenum; carbides of tungsten or silicon; silicon nitride; aluminum oxide; and sulfides of manganese or molybdenum. In general, the total amount of alloying powder present is minor, generally up to about 3% by weight of the total powder weight, although as much as 10–15% by weight can be present for certain specialized powders.

The binder can be added to the powder mixture according to procedures taught by U.S. Pat. No. 4,483,905, the disclosures of which are hereby incorporated by reference. Generally, however, a dry mixture of the iron-based powder and alloying powder is made by conventional techniques, after which the binding agent is added, preferably in liquid form, and mixed with the powders until good wetting of the powders is attained. The wet powder is then spread over a shallow tray and allowed to dry, occasionally with the aid of heat or vacuum. Those binding agents of the present invention which are in liquid form under ambient conditions can be added to the dry powder as such, although they are preferably diluted in an organic solvent to provide better dispersion of the binder in the powder mixture, thus providing a substantially homogeneous distribution of the binder throughout the mixture. Solid binding agents are generally dissolved in an organic solvent and added as this liquid solution.

The amount of binding agent to be added to the powder composition depends on such factors as the density and particle size distribution of the alloying powder, and the relative weight of the alloying powder in the composition. Generally, the binder will be added to the powder composition in an amount of about 0.005–1.0% by weight based on the total powder composition weight. More specifically, however, for those alloying powders having a mean particle size below about 20 microns, a criterion which applies to most alloying powders, it has been found that good resistance to segregation and dusting can be obtained by the addition of binding agent in an amount according to the following table.

| Density of Alloying Powders | Weight Ratio of Binding Agent to Alloying Powder |
|---|---|
| ≦2.5 | 0.125 |
| >2.5–4.5 | 0.100 |
| >4.5–6.5 | 0.050 |
| >6.5 | 0.025 |

Where more than one alloying powder is present, the amount of binder attributable to each such powder is determined from the table, and the total added to the powder composition.

In use, an improved powder composition of this invention is compacted in a die at a pressure of about 275–700 mega-newtons per square millimeter ($MN/mm^2$), followed by sintering at a temperature and for a time sufficient to alloy the composition. Normally a lubricant is mixed directly into the powder composition, usually in an amount up to about 1% by weight, although the die itself may be provided with a lubricant on the die wall. Preferable lubricants are those which pyrolyze cleanly during sintering. Examples of suitable lubricants are zinc stearate or one of the synthetic waxes available from Glyco Chemical Company as "ACRAWAX."

EXAMPLES

In each of the following examples, a mixture of an iron-based powder, an alloying powder, and a binding agent was prepared. The "binder-treated" mixtures were prepared by first mixing the iron powder and alloying powder in standard laboratory bottle-mixing equipment for 20–30 minutes. The resultant dry mixture was transferred to an appropriately sized bowl of an ordinary food mixer. Care was taken throughout to avoid any dusting of the powder. Binder was then added to the powder mixture, typically in the form of a solution in an organic solvent, and blended with the powder with the aid of spatula. Blending was continued until the mixture had a uniform, wet appearance. Thereafter, the wet mixture was spread out on a shallow metal tray and allowed to dry. After drying, the mixture was coaxed through a 40-mesh screen to break up any large agglomerates which may have formed during the drying. A portion of the powder mixture was set aside for chemical analysis and dusting-resistance determination. The remainder of the mixture was divided into two parts, each part blended with either 0.75% by weight "ACRAWAX C" or 1.0% by weight zinc stearate, and these mixtures were used to test the green properties and sintered properties of the powder composition.

The mixtures were tested for dusting resistance by elutriating them with a controlled flow of nitrogen. The test apparatus consisted of a cylindrical glass tube vertically mounted on a two-liter Erlenmeyer flask equipped with a side port to receive the flow of nitrogen. The glass tube (17.5 cm in length; 2.5 cm inside diameter) was equipped with a 400-mesh screen plate positioned about 2.5 cm above the mouth of the Erlenmeyer flask. A 20–25 gram sample of the powder mixture to be tested was placed on the screen plate, and nitrogen was passed through the tube at a rate of 2 liters per minute for 15 minutes. At the conclusion of the test, the powder mixture was analayzed to determine the relative amount of alloying powder remaining in the mixture (expressed as a percentage of the before-test concentration of the alloying powder), which is a measure of the composition's resistance to loss of the alloying powder through dusting/segregation.

The apparent density (ASTM B212-76) and flow (ASTM B213-77) of the powder composition of each example was also determined. The compositions were pressed into green bars at a compaction pressure of $414MN/mm^2$, and the green density (ASTM B331-76) and green strength (ASTM B312-76) were measured. A second set of green bars was pressed to a density of 6.8 g/cc and then sintered at about 1100°–1150° C. in dissociated ammonia atmosphere for 30 minutes, and the dimensional change (ASTM B610-76), transverse rupture strength (ASTM B528-76), and sintered density (ASTM B331-76) were determined.

Examples 1 and 2 are included for comparison purposes, and show the effect of two of the binders disclosed in U.S. Pat. No. 4,483,905. Examples 3–9 illustrate binders of the present invention. In the examples, unless otherwise indicated all percentages indicate percent by weight.

EXAMPLE 1

A mixture of the following composition was prepared: 1.0% graphite (Asbury grade 3202); 0.125% polyethylene glycol (Union Carbide Carbowax 3350); balance, iron powder (Hoeganaes AST 1000). The polyethylene glycol was introduced as part of a 10% solution in methanol. Another mixture having the same composition and ingredients but without polyethylene glycol was prepared and tested as a control mixture. Results of the tests associated with these mixtures are shown in Table 1.

TABLE 1

| ADDITIVE/PROPERTY | CONTROL MIX | | BINDER-TREATED MIX | |
|---|---|---|---|---|
| | DUSTING RESISTANCE (Percent of original amount of additive remaining) | | | |
| Graphite | | 33.0 | | 70.0 |
| Lubricant | Zinc Stearate | ACRAWAX | Zinc Stearate | ACRAWAX |
| | GREEN PROPERTIES | | | |
| Apparent Density (g/cc) | 3.13 | 3.00 | 3.20 | 3.04 |

TABLE 1-continued

| ADDITIVE/PROPERTY | CONTROL MIX | | BINDER-TREATED MIX | |
|---|---|---|---|---|
| | DUSTING RESISTANCE (Percent of original amount of additive remaining) | | | |
| Flow (sec/50 g) | 42.0 | 39.6 | 39.7 | 39.3 |
| Green/Density (g/cc) | 6.69 | 6.70 | 6.71 | 6.70 |
| Green Strength (N/mm$^2$) | 924 | 1170 | 1050 | 1290 |
| | SINTERED PROPERTIES | | | |
| Sintered Density (g/cc) | 6.72 | 6.75 | 6.71 | 6.74 |
| Dimensional Change (%) | +0.18 | 0.21 | +0.17 | +0.22 |
| TRS (N/mm$^2$) | 79,790 | 79,590 | 80,740 | 81,020 |
| Rockwell Hardness (Rb) | 71 | 73 | 73 | 73 |
| | SINTERED CHEMISTRIES | | | |
| Carbon (%) | 0.85 | 0.87 | 0.88 | 0.87 |
| Oxygen (%) | 0.055 | 0.056 | 0.063 | 0.05 |

EXAMPLE 2

A test mixture of the following composition was prepared: 1.0% graphite (Asbury grade 3203); 0.125% polyvinyl alcohol (Air Products PVA grade 203); balance, iron powder (Hoeganaes AST 1000). Polyvinyl alcohol was introduced in the form of a 10% solution in water. Another mixture having the same composition and ingredients but without the polyvinyl alcohol was prepared and tested as a control. Results of the tests associated with these mixtures are presented in Table 2.

TABLE 2

| ADDITIVE/PROPERTY | CONTROL MIX | | BINDER-TREATED MIX | |
|---|---|---|---|---|
| | DUSTING RESISTANCE (Percent of original amount of additive remaining) | | | |
| Graphite | | 46.0 | | 92.0 |
| Lubricant | Zinc Stearate | ACRAWAX | Zinc Stearate | ACRAWAX |
| | GREEN PROPERTIES | | | |
| Apparent Density (g/cc) | 3.06 | 2.92 | 2.79 | 2.90 |
| Flow (sec/50 g) | 39.1 | 36.9 | 32.5 | 30.1 |
| Green/Density (g/cc) | 6.68 | 6.68 | 6.62 | 6.62 |
| Green Strength (N/mm$^2$) | 1080 | 1210 | 980 | 1120 |
| | SINTERED PROPERTIES | | | |
| Sintered Density (g/cc) | 6.72 | 6.73 | 6.71 | 6.74 |
| Dimensional Change (%) | +0.22 | +0.19 | +0.24 | +0.09 |
| TRS (N/mm$^2$) | 76,760 | 77,400 | 56,150 | 76,250 |
| Rockwell Hardness (Rb) | 68 | 69 | 67 | 68 |
| | SINTERED CHEMISTRIES | | | |
| Carbon (%) | 0.84 | 0.84 | 0.83 | 0.86 |
| Oxygen (%) | 0.071 | 0.063 | 0.070 | 0.072 |

EXAMPLE 3

A test mixture of the following composition was prepared: 1.0% graphite (Asbury grade 3203); 0.125% polyvinyl acetate (Air Products Vinac B-15); balance, iron powder (Hoeganaes AST 1000). The polyvinyl acetate was introduced as a 10% solution in acetone. Another mixture having the same composition and ingredients but without the polyvinyl acetate was prepared and tested as a control. Results of the tests associated with these mixtures are presented in Table 3.

A comparison of Table 3 with Table 2 shows that the polyvinylacetate of the present invention retains the excellent dusting resistance of the prior art polyvinyl alcohol, but does not suffer from the decreases in green density, sintered dimensional change, or sintered strength associated with the use of the alcohol. Comparison of Table 3 with Table 1 shows that the polyvinyl acetate of the invention provides dusting resistance and flow properties superior to those provided by the polyethylene glycol of the prior art.

TABLE 3

| ADDITIVE/PROPERTY | CONTROL MIX | | BINDER-TREATED MIX | |
|---|---|---|---|---|
| | DUSTING RESISTANCE (Percent of original amount of additive remaining) | | | |
| Graphite | | 46.0 | | 94.0 |
| Lubricant | Zinc Stearate | ACRAWAX | Zinc Stearate | ACRAWAX |
| | GREEN PROPERTIES | | | |
| Apparent Density (g/cc) | 3.06 | 2.92 | 3.03 | 2.92 |
| Flow (sec/50 g) | 39.1 | 36.9 | 31.4 | 31.4 |
| Green/Density (g/cc) | 6.68 | 6.68 | 6.66 | 6.66 |
| Green Strength (N/mm$^2$) | 1080 | 1210 | 990 | 1150 |
| | SINTERED PROPERTIES | | | |
| Sintered Density (g/cc) | 6.72 | 6.73 | 6.72 | 6.74 |
| Dimensional Change (%) | +0.22 | +0.21 | +0.19 | +0.16 |

TABLE 3-continued

| ADDITIVE/PROPERTY | CONTROL MIX | | BINDER-TREATED MIX | |
|---|---|---|---|---|
| | DUSTING RESISTANCE (Percent of original amount of additive remaining) | | | |
| TRS (N/mm$^2$) | 77,470 | 78,470 | 76,630 | 82,230 |
| Rockwell Hardness (Rb) | 68 | 69 | 70 | 71 |
| | SINTERED CHEMISTRIES | | | |
| Carbon (%) | 0.85 | 0.84 | 0.88 | 0.88 |
| Oxygen (%) | 0.058 | 0.051 | 0.067 | 0.055 |

EXAMPLE 4

A test mixture of the following composition was prepared: 0.9% graphite (Asbury Grade 3203); 0.1% cellulose acetate butyrate (Eastman Co., CAB-551-0.2); balance, iron powder (Hoeganaes AST 1000). The cellulose acetate butyrate was introduced as a 10% solution in ethyl acetate. Another mixture having the same composition and ingredients but without the cellulose acetate butyrate was prepared and tested as a control. Results of the tests associated with these mixtures are presented in Table 4. A comparison of Table 4 with each of Tables 1 and 2 shows that compositions treated with the cellulose acetate butyrate of the invention exhibit improvement in the graphite dusting resistance and powder flow compared to compositions treated with the prior art binders.

TABLE 4

| ADDITIVE/PROPERTY | CONTROL MIX | | BINDER-TREATED MIX | |
|---|---|---|---|---|
| | DUSTING RESISTANCE (Percent of original amount of additive remaining) | | | |
| Graphite | 30 to 45* | | 94.0 | |
| Lubricant | Zinc Stearate | ACRAWAX | Zinc Stearate | ACRAWAX |
| | GREEN PROPERTIES | | | |
| Apparent Density (g/cc) | 3.15 | 3.00 | 3.15 | 2.96 |
| Flow (sec/50 g) | 32.5 | 34.0 | 28.3 | 30.2 |
| Green/Density (g/cc) | 6.66 | 6.67 | 6.66 | 6.66 |
| Green Strength (N/mm$^2$) | 930 | 1160 | 920 | 1120 |
| | SINTERED PROPERTIES | | | |
| Sintered Density (g/cc) | 6.75 | 6.75 | 6.75 | 6.75 |
| Dimensional Change (%) | +0.07 | +0.11 | +0.08 | +0.09 |
| TRS (N/mm$^2$) | 68,480 | 70,970 | 68,620 | 68,480 |
| Rockwell Hardness (Rb) | 52 | 55 | 56 | 56 |
| | SINTERED CHEMISTRIES | | | |
| Carbon (%) | 0.82 | 0.84 | 0.85 | 0.84 |
| Oxygen (%) | 0.051 | 0.050 | 0.051 | 0.053 |

*not actually tested; values indicated are typical for mixtures of this kind

EXAMPLE 5

A test mixture of the following composition was prepared: 0.4% graphite (Asbury Grade 3203); 5.13% ferrophosphorus (binary alloy, normally containing 15–16% phosphorus); 0.25% n-butyl methacrylate (Dupont Co. Elvacite 2044); balance, iron powder (Hoeganaes AST 1000B). The n-butyl methacrylate polymer was added as a 10% solution in methyl ethyl ketone. Another mixture having the same composition and ingredients but without the methacrylate polymer was prepared and tested as a control. Results of the tests associated with these mixtures are presented in Table 5, below.

In a related experiment, a mixture of the same ingredients as those used in this Example 5 but containing 0.26% graphite and 0.9% ferrophosphorous was also prepared and tested with 0.35% polyethylene glycol, of the prior art, as a binder. Although the polyethylene glycol was used in higher concentration than the methacrylate binder of the invention in this comparison (0.35% as opposed to 0.25%), the resultant dusting resistances imparted to the graphite and ferrophosphorus were only 78% and 63%, respectively (as compared to the values of 100% and 91%, respectively, as shown in Table 5).

TABLE 5

| ADDITIVE/PROPERTY | CONTROL MIX | | BINDER-TREATED MIX | |
|---|---|---|---|---|
| | DUSTING RESISTANCE (Percent of original amount of additive remaining) | | | |
| Graphite | 22.0 | | 100.0 | |
| Phosphorus | 20.0 | | 91.0 | |
| Lubricant | Zinc Stearate | ACRAWAX | Zinc Stearate | ACRAWAX |
| | GREEN PROPERTIES | | | |
| Apparent Density (g/cc) | 3.90 | 3.13 | 3.19 | 3.07 |
| Flow (sec/50 g) | 37.5 | 35.3 | 30.2 | 30.2 |
| Green/Density (g/cc) | 6.72 | 6.71 | 6.68 | 6.68 |
| Green Strength (N/mm$^2$) | 1210 | 1420 | 1110 | 1230 |
| | SINTERED PROPERTIES | | | |
| Sintered Density (g/cc) | 6.62 | 6.58 | 6.62 | 6.62 |

TABLE 5-continued

| ADDITIVE/PROPERTY | CONTROL MIX | | BINDER-TREATED MIX | |
|---|---|---|---|---|
| | DUSTING RESISTANCE (Percent of original amount of additive remaining) | | | |
| Dimensional Change (%) | +0.77 | +0.93 | +0.67 | +0.78 |
| TRS (N/mm$^2$) | 102,400 | 104,140 | 102,400 | 104,620 |
| Rockwell Hardness (Rb) | 69 | 70 | 70 | 70 |
| | SINTERED CHEMISTRIES | | | |
| Carbon (%) | 0.36 | 0.37 | 0.35 | 0.37 |
| Phosphorus (%) | 0.83 | 0.85 | 0.82 | 0.78 |
| Oxygen (%) | 0.042 | 0.049 | 0.038 | 0.049 |

EXAMPLE 6

A test mixture of the following composition was prepared: 0.9% graphite (Asbury grade 3203); 0.10% alkyd resin precursor (Cargill Company Vinyl-Toluene Alkyd Copolymer 5303); balance, iron powder (Hoeganaes AST 1000). The vinyl-toluene alkyd-copolymer mixture was dispersed in 9 weight parts of acetone per part of binder mixture, and added to the composition in that form. Another mixture having the same composition and ingredients without the vinyl-toluene alkyd copolymer was prepared and tested as a control. Results of the tests associated with these mixtures are shown in Table 6.

TABLE 6

| ADDITIVE/PROPERTY | CONTROL MIX | | BINDER-TREATED MIX | |
|---|---|---|---|---|
| | DUSTING RESISTANCE (Percent of original amount of additive remaining) | | | |
| Graphite | 30–45 | | 93.0 | |
| Lubricant | Zinc Stearate | ACRAWAX | Zinc Stearate | ACRAWAX |
| | GREEN PROPERTIES | | | |
| Apparent Density (g/cc) | 3.17 | 2.99 | 3.10 | 3.01 |
| Flow (sec/50 g) | 38.4 | 36.9 | 32.7 | 31.1 |
| Green/Density (g/cc) | 6.70 | 6.71 | 6.71 | 6.70 |
| Green Strength (N/mm$^2$) | 1100 | 1170 | 1020 | 1140 |
| | SINTERED PROPERTIES | | | |
| Sintered Density (g/cc) | 6.73 | 6.73 | 6.73 | 6.74 |
| Dimensional Change (%) | +0.08 | +0.19 | +0.11 | +0.18 |
| TRS (N/mm$^2$) | 70,360 | 70,850 | 69,870 | 72,040 |
| Rockwell Hardness (Rb) | 64 | 65 | 65 | 66 |
| | SINTERED CHEMISTRIES | | | |
| Carbon (%) | 0.79 | 0.83 | 0.79 | 0.81 |
| Oxygen (%) | 0.077 | 0.073 | 0.070 | 0.053 |

EXAMPLE 7

A test mixture of the following composition was prepared: 1.0% graphite (Asbury grade 3203); 0.10% moisture-curing polyurethane prepolymer (Mobay Mondur XP-743, an aromatic polyisocyanate); balance iron powder (Hoeganaes AST 1000). The polyurethane prepolymer was introduced as a 10% solution in acetone. The wet mixture was submitted to heat and vacuum to remove the solvent and then exposed to moisture in the air to cure the prepolymer. Results associated with the tests of this mixture are shown in Table 7. A comparison with Tables 1 and 2 shows that the dusting resistance provided by the polyurethane of this invention (85%) is higher than that provided by polyethylene glycol (70%) and lower (but still commercially acceptable) than that provided by polyvinyl alcohol (92%). Nevertheless, the green strength values, an important property, attained with the polyurethane are significantly higher than those attained with the two prior art binders, and this improvement as a practical matter offsets a decrease in the other property.

TABLE 7

| ADDITIVE/PROPERTY | Binder-Treated Mix | |
|---|---|---|
| | DUSTING RESISTANCE (Percent of original amount of additive remaining) | |
| Graphite | 85.0 | |
| Lubricant | Zinc Stearate | ACRAWAX |
| | GREEN PROPERTIES | |
| Apparent Density (g/cc) | 3.03 | 3.02 |
| Flow (sec/50 g) | 37.6 | 32.5 |
| Green/Density (g/cc) | 6.71 | 6.69 |
| Green Strength (N/mm$^2$) | 1210 | 1390 |
| | SINTERED PROPERTIES | |
| Sintered Density (g/cc) | 6.71 | 6.72 |
| Dimensional Change (%) | +0.17 | +0.21 |
| TRS (N/mm$^2$) | 79,780 | 76,200 |
| Rockwell Hardness (Rb) | 70 | 71 |
| | SINTERED CHEMISTRIES | |
| Carbon (%) | 0.88 | 0.87 |
| Oxygen (%) | 0.073 | 0.055 |

EXAMPLE 8

A test mixture of the following composition was prepared: 0.9% graphite (Asbury grade 3203); 0.10% polyester resin mixture (Dow Derakene grade 470-36 styrene-diluted vinyl ester resin); balance, iron powder (Hoeganaes AST-1000). The polyester mixture was diluted in 9 weight parts of acetone per weight part of polyester resin mixture and added in that form. The resin solution contained 0.150% methyl ethyl ketone peroxide and 0.05% cobalt napthenate. After the resin solution was added, the wet powder mixture was submitted to heat and vacuum to remove the acetone and to permit the binder to cure. Another mixture having the same composition and ingredients but without the polyester resin was prepared and tested as a control. The results associated with the tests of these mixtures are shown in Table 8. Comparison of Table 8 with Tables 1 and 2 indicates that the tested resin of this invention provides improvement in dusting resistance, powder flow, and green strength when compared to the binders of the prior art.

TABLE 8

| ADDITIVE/PROPERTY | CONTROL MIX | | BINDER-TREATED MIX | |
|---|---|---|---|---|
| | DUSTING RESISTANCE (Percent of original amount of additive remaining) | | | |
| Graphite | | 30–45 | | 95.0 |
| Lubricant | Zinc Stearate | ACRAWAX | Zinc Stearate | ACRAWAX |
| | GREEN PROPERTIES | | | |
| Apparent Density (g/cc) | 3.17 | 2.99 | 3.02 | 3.02 |
| Flow (sec/50 g) | 38.4 | 36.9 | 29.9 | 30.35 |
| Green/Density (g/cc) | 6.70 | 6.71 | 6.70 | 6.69 |
| Green Strength (N/mm$^2$) | 1100 | 1170 | 1250 | 1410 |
| | SINTERED PROPERTIES | | | |
| Sintered Density (g/cc) | 6.74 | 6.73 | 6.74 | 6.74 |
| Dimensional Change (%) | +0.13 | +0.20 | +0.13 | +0.15 |
| TRS (N/mm$^2$) | 70,420 | 69,740 | 72,670 | 74,540 |
| Rockwell Hardness (Rb) | 68 | 69 | 70 | 71 |
| | SINTERED CHEMISTRIES | | | |
| Carbon (%) | 0.76 | 0.78 | 0.79 | 0.79 |
| Oxygen (%) | 0.084 | 0.098 | 0.089 | 0.089 |

EXAMPLE 9

A test mixture of the following composition was prepared: 1.0% graphite (Asbury grade 3203); 2.0 weight percent nickel (International Nickel Inc. grade HDNP); 0.175% polyvinyl acetate (Air Products PVA B-15); balance, iron powder (Hoeganaes AST 1000). The polyvinyl acetate was introduced as a 10% solution in acetone. Another mixture having the same composition and ingredients but without the polyvinyl acetate was prepared and tested as a control. Results associated with the tests of these mixtures are shown in Table 9.

TABLE 9

| ADDITIVE/PROPERTY | CONTROL MIX | | BINDER-TREATED MIX | |
|---|---|---|---|---|
| | DUSTING RESISTANCE (Percent of original amount of additive remaining) | | | |
| Graphite | | 28.0 | | 94.0 |
| Nickel | | 25.0 | | 91.0 |
| Lubricant | Zinc Stearate | ACRAWAX | Zinc Stearate | ACRAWAX |
| | GREEN PROPERTIES | | | |
| Apparent Density (g/cc) | 3.12 | 2.96 | 3.03 | 2.92 |
| Flow (sec/50 g) | 45.7 | 44.4 | 34.5 | 33.3 |
| Green/Density (g/cc) | 6.68 | 6.69 | 6.68 | 6.68 |
| Green Strength (N/mm$^2$) | 860 | 1100 | 810 | 1020 |
| | SINTERED PROPERTIES | | | |
| Sintered Density (g/cc) | 6.76 | 6.77 | 6.76 | 6.79 |
| Dimensional Change (%) | +0.500 | +0.080 | +0.002 | +0.001 |
| TRS (N/mm$^2$) | 87,030 | 86,110 | 85,100 | 87,100 |
| Rockwell Hardness (Rb) | 74 | 75 | 75 | 77 |
| | SINTERED CHEMISTRIES | | | |
| Carbon (%) | 0.85 | 0.85 | 0.87 | 0.88 |
| Nickel | 2.05 | 2.15 | 2.11 | 2.29 |
| Oxygen (%) | 0.069 | 0.077 | 0.057 | 0.054 |

What is claimed is:

1. An improved metallurgical powder composition comprising (a) an iron-based powder having an average particle size less than about 80 microns selected from the group consisting of iron powders and steel powders, (b) a minor amount of at least one alloying powder, and (c) about 0.005–1% by weight of a binding agent for said iron-based and alloying powders, said composition having been formed by mechanically mixing said iron-based powder and said alloying powder with said binding agent, wherein the improvement is characterized in that the binding agent is a resin substantially insoluble in water selected from the group consisting of (1) Homopolymers of vinyl acetate or copolymers of vinyl acetate in which at least 70% of the monomeric units are vinyl acetate;

(2) Cellulosic ester or ether resins;

(3) Methacrylate polymers or copolymers;

(4) Alkyd resins;

(5) Polyurethane resins; and (6) Polyester resins.

2. A composition of claim 1 in which the binding agent is a homopolymer or copolymer of vinyl acetate.

3. A composition of claim 2 in which the binding agent is polyvinyl acetate.

4. A composition of claim 2 in which the iron-based powder has an average particle size of about 70–80 microns.

5. A composition of claim 1 in which the binding agent is a cellulose resin selected from the group consisting of ethyl cellulose, cellulose acetate, cellulose acetate butyrate, and nitrocellulose.

6. A composition of claim 5 in which the binding agent is cellulose acetate butyrate.

7. A composition of claim 5 in which the iron-based powder has an average particle size of about 70–80 microns.

8. A composition of claim 1 in which the binding agent is a methacrylate resin selected from the group consisting of polymethyl methacrylate, polyethyl methacrylate, polybutyl methacrylate, methyl/butyl methacrylate copolymer, and methyl/ethyl methacrylate copolymer.

9. A composition of claim 8 in which the binding agent is n-butyl methacrylate homopolymer.

10. A composition of claim 8 in which the iron-based powder has an average particle size of about 70–80 microns.

11. A composition of claim 1 in which the binding agent is an alkyd resin.

12. A composition of claim 11 in which the alkyd resin is modified with a drying oil.

13. A composition of claim 11 in which the alkyd resin is modified with a polymerized ethylenically-unsaturated monomer.

14. A composition of claim 13 in which the alkyd resin is a pre-polymer of phthalic acid or phthalic anhydride and ethylene glycol, said pre-polymer modified with a vinyl-toluene polymer.

15. A composition of claim 11 in which the iron-based powder has an average particle size of about 70–80 microns.

16. A composition of claim 1 in which the binding agent is a polyurethane resin.

17. A composition of claim 16 in which the polyurethane resin is cured by exposure to ambient moisture.

18. A composition of claim 16 in which the polyurethane resin is cured from a prepolymer containing free isocyanate groups and a cross-linking agent selected from the group consisting of polyamines and monomeric polyols.

19. A composition of claim 16 in which the iron-based powder has an average particle size of about 70–80 microns.

20. A composition of claim 1 in which the binding agent is a polyester resin.

21. A composition of claim 20 in which the polyester resin is the reaction product of (a) the condensation product of an unsaturated dicarboxylic acid having 4–6 carbon atoms and a dihydroxy alcohol having 2–4 carbon atoms, and (b) an ethylenically unsaturated monomer.

22. A composition of claim 21 in which the condensation product is of maleic or fumaric acid and ethylene glycol, and in which the monomer is diallyl phthalate, vinyl toluene, styrene, or a methacrylate resin.

23. A composition of claim 21 in which the condensation product is of maleic acid and ethylene glycol, and in which the monomer is styrene.

24. A composition of claim 20 in which the iron-based powder has an average particle size of about 70–80 microns.

25. A composition of claim 1, 5, 8, 11, 16, or 21 in which the alloying powder has a mean particle size up to about 20 microns and in which the weight ratio of binding agent to alloying powder in the composition is dependent on the density of the alloying powder and is in accordance with the following schedule.

| Density of Alloying Powder | Weight Ratio of Binding Agent to Alloying Powder |
|---|---|
| ≦2.5 | 0.125 |
| >2.5–4.5 | 0.100 |
| >4.5–6.5 | 0.050 |
| >6.5 | 0.025 |

26. A composition of claim 11 in which the iron-based powder has an average particle size of about 70–80 microns.

27. A composition of claim 6 in which the alloying powder has an average particle size up to about 20 microns.

28. A composition of claim 4 in which the alloying powder has an average particle size up to about 20 microns.

29. A composition of claim 7 in which the alloying powder has an average particle size up to about 20 microns.

30. A composition of claim 10 in which the alloying powder has an average particle size up to about 20 microns.

31. A composition of claim 15 in which the alloying powder has an average particle size up to about 20 microns.

32. A composition of claim 19 in which the alloying powder has an average particle size up to about 20 microns.

33. A composition of claim 24 in which the alloying powder has an average particle size up to about 20 microns.

34. A composition of claim 25 in which the iron-bsed powder has an average particle size of about 70–80 microns.

35. An improved metallurgical powder composition comprising (a) an iron-based powder selected from the group consisting of iron powders and steel powders, (b) a minor amount of at least one alloying powder, and (c) about 0.005–1% by weight of a binding agent for said iron-based and alloying powders, said composition having been formed by mechanically mixing said iron-based powder and said alloying powder with said binding agent, wherein the improvement is characterized in that the binding agent is a resin substantially insoluble in water selected from the group consisting of (1) Homopolymers of vinyl acetate or copolymers of vinyl acetate in which at least 70% of the monomeric units are vinyl acetate;
(2) Cellulosic ester or ether resins;
(3) Methacrylate polymers or copolymers;
(4) Alkyd resins;
(5) Polyurethane resins; and
(6) Polyester resins; and wherein the alloying powder has a mean particle size up to about 20 microns and the weight ratio of binding agent to alloying powder in the composition is dependent on the density of the alloying powder and is in accordance with the following schedule.

| Density of Alloying Powder (g/cc) | Weight Ratio of Binding Agent to Alloying Powder |
|---|---|
| ≦2.5 | 0.125 |
| >2.5–4.5 | 0.100 |
| >4.5–6.5 | 0.050 |
| >6.5 | 0.025 |

* * * * *

UNITED STATES PATENT AND TRADEMARK OFFICE

CERTIFICATE OF CORRECTION

PATENT NO. : 4,834,800

DATED : May 30, 1989

INVENTOR(S) : Frederick J. Semel

It is certified that error appears in the above-identified patent and that said Letters Patent is hereby corrected as shown below:

In claim 26, line 1, "claim 11" should read --claim 1--

In claim 27, line 1, "claim 6" should read --claim 26--

Signed and Sealed this

Thirteenth Day of February, 1990

*Attest:*

JEFFREY M. SAMUELS

*Attesting Officer*

*Acting Commissioner of Patents and Trademarks*

UNITED STATES PATENT AND TRADEMARK OFFICE

CERTIFICATE OF CORRECTION

PATENT NO. : 4,834,800

DATED : May 30, 1989

INVENTOR(S) : Frederick J. Semel

It is certified that error appears in the above-identified patent and that said Letters Patent is hereby corrected as shown below:

Claim 26, line 1, "claim 11" should read --claim 1--.

Claim 27, line 1, "claim 6" should read --claim 26--.

Signed and Sealed this

Thirteenth Day of March, 1990

*Attest:*

JEFFREY M. SAMUELS

*Attesting Officer*

*Acting Commissioner of Patents and Trademarks*